US009222434B2

(12) United States Patent
Resch

(10) Patent No.: US 9,222,434 B2
(45) Date of Patent: Dec. 29, 2015

(54) ENGINE HOUSING OF AN INTERNAL COMBUSTION ENGINE AND INTERNAL COMBUSTION ENGINE FITTED THEREWITH

(71) Applicant: STEYR MOTORS GmbH, Steyr (AT)

(72) Inventor: Bernhard Resch, Steinbach an der Steyr (AT)

(73) Assignee: STEYR MOTORS GmbH, Steyr (AT)

( * ) Notice: Subject to any disclaimer, the term of this patent is extended or adjusted under 35 U.S.C. 154(b) by 0 days.

(21) Appl. No.: 14/288,558

(22) Filed: May 28, 2014

(65) Prior Publication Data

US 2015/0034038 A1 Feb. 5, 2015

(30) Foreign Application Priority Data

Aug. 1, 2013 (AT) ..... 50486/2013

(51) Int. Cl.
*F02F 7/00* (2006.01)
*F02F 1/00* (2006.01)

(52) U.S. Cl.
CPC ..... *F02F 7/0021* (2013.01); *F02F 1/002* (2013.01)

(58) Field of Classification Search
CPC ..... B22D 19/0009; F02F 2007/0041; F02F 7/0085; F02F 1/002; F02F 7/0021; F02F 7/0058; F01P 3/02
USPC ..... 123/193.5, 193.1, 193.2; 92/146, 147, 92/152, 169.1, 171.1, 12.2
See application file for complete search history.

(56) References Cited

U.S. PATENT DOCUMENTS

| | | | | | |
|---|---|---|---|---|---|
| 3,046,952 | A * | 7/1962 | Dolza | F02F 7/0007 | 123/195 R |
| 4,616,603 | A * | 10/1986 | Kubis | F02B 75/16 | 123/193.2 |
| 4,644,911 | A | 2/1987 | Hidaka et al. | | |
| 4,708,105 | A | 11/1987 | Leydorf, Jr. et al. | | |
| 6,076,494 | A * | 6/2000 | Kampichler | F02F 7/0058 | 123/193.3 |
| 6,513,506 | B1 * | 2/2003 | Ito | F01N 13/011 | 123/193.5 |
| 6,976,466 | B2 * | 12/2005 | Gibisch | B22D 19/0009 | 123/193.2 |
| 8,528,512 | B2 * | 9/2013 | Christl | F02F 1/24 | 123/193.1 |

FOREIGN PATENT DOCUMENTS

| | | | |
|---|---|---|---|
| DE | 23 49 173 | A1 | 4/1975 |
| DE | 34 36 872 | A1 | 4/1985 |
| DE | 102 08 299 | A1 | 9/2003 |
| EP | 0 227 383 | A2 | 7/1987 |
| GB | 2 425 570 | A | 11/2006 |
| JP | S59-126051 | A | 7/1984 |
| JP | S63-79453 | U | 5/1988 |
| JP | H05-296103 | A | 11/1993 |
| WO | 2004/111418 | A1 | 12/2004 |

* cited by examiner

*Primary Examiner* — Lidsay Low
*Assistant Examiner* — Long T Tran
(74) *Attorney, Agent, or Firm* — Collard & Roe, P.C.

(57) ABSTRACT

The invention relates to an engine housing (4) with a cylinder block (6) and a cylinder head unit (5) comprising a head portion (8) and at least one integrally cast cylinder portion (9) with an internally lying piston bearing surface (11). The cylinder portion (9) of the cylinder head unit (5) can be pushed at least partially in the axial direction of the cylinder portion (12) into the cylinder block (6). The cylinder head unit (5) can also be clamped in the axial direction of the cylinder portion (12) against the cylinder block (6) by means of at least one fixing element (23).

14 Claims, 3 Drawing Sheets

ENGINE HOUSING OF AN INTERNAL COMBUSTION ENGINE AND INTERNAL COMBUSTION ENGINE FITTED THEREWITH

CROSS-REFERENCE TO RELATED APPLICATIONS

Applicant claims priority under 35 U.S.C. §119 of Austrian Application No. A 50486/2013 filed on Aug. 1, 2013, the disclosure of which is incorporated by reference.

The invention relates to an engine housing of an internal combustion engine as well as an internal combustion engine fitted with this engine housing.

U.S. Pat. No. 4,708,105 A discloses an internal combustion engine based on a monoblock design, in which the at least one cylinder with an internally lying bearing surface for a piston is made jointly with at least one cylinder head as a single-piece cast unit and forms an integral cylinder head unit. The engine or cylinder block of the internal combustion engine is split in a vertical plane along the in-line cylinders so that the cylinder block is made up of two half-shells with a vertical dividing or joint plane. These half-shells are dimensioned so that the top part of the cylinder block supporting or partially accommodating the cylinder head unit as well as the bottom part of the cylinder block constituting the crankcase are each half defined by the two half-shells of the cylinder block construction. The mutual support between the cylinder head unit and cylinder block is provided by means of two support zones spaced apart from one another in the direction of piston movement. A first support zone is positioned approximately at the height of the cylinder base of the cylinder head unit and the cylinder head unit is supported by means of a horizontal support surface and an intervening seal on the half-shells of the cylinder block. A coolant passage through which a cooling medium circulates is sealed off from the environment outside the internal combustion engine by means of this seal. Another support zone with another sealing element is disposed immediately adjacent to the open end of the cylinder of the cylinder head unit. In addition, a continuous projection or rib-type extension is provided on the external wall of the cylinder. This extension locates in a positive fit in a corresponding groove-shaped recess in the internal faces of the two half-shells of the cylinder block. In the usage state, the two half-shells of the cylinder block are joined and are clamped to one another by screws extending transversely to the cylinder base. Due to the positive engagement between the rib-type extensions on the cylinder and the groove-type recesses in the internal faces of the half-shells of the cylinder block, the cylinder head unit is fixed relative to the cylinder block in the axial direction of the cylinder.

In the case of the engine known from GB 2 425 570 A based on a monoblock design, a cylinder head unit is produced from one integrally cast piece into which a liner for guiding the piston in a sliding movement is pressed. All the inlet and outlet passages for the combustion air and for the exhaust gases as well as plug-in orifices for a spark plug or an injector are incorporated in this cylinder head unit. A coolant passage is also provided in the cylinder head unit for circulating a cooling medium. A crankcase for housing and mounting the crankshaft has a continuous retaining web in the bottom end portion to provide a connection to an oil pan constituting the bottom closing portion of the engine. The crankcase is closed in the direction towards the bottom, in particular based on a hollow cylindrical design, and its cylinder axis extends horizontally. When the engine housing is assembled, the cylinder head unit is placed on the crankcase, which is open exclusively at the top, and then clamped to the crankcase by a bolt arrangement lying in the direction of piston movement and extending through the entire engine housing, the bolt heads of which are supported on the base portion of the crankcase, which is closed at the bottom.

WO 2004/111418 A1 discloses another monoblock design, in which at least one cylinder and at least one cylinder head are produced as an integrally cast component and thus combined to form a cylinder head unit. A piston liner for each cylinder is pressed into the cylinder head unit. The cylinder or engine block is a cast component comprising at least a top part portion of the crankcase and on which crankcase side walls are formed extending to a level above the cylinder head unit forming at least one bearing for at least one upper camshaft for controlling the valves. Coolant passages are integrated in these upwardly extending side walls, through which a coolant fluid circulates. The cylinder head unit is fitted in the cylinder block unit by means of an axial pushing movement in the direction of piston movement.

The problem with the design described in U.S. Pat. No. 4,708,105 A is that, due to the fact that the crankcase is vertically split, it has to be bolted transversely to the direction in which the pistons move. Another disadvantage of this design is that the seal between the cylinder head unit and cylinder block is problematic and is at risk of developing leaks in the longer term. Furthermore, there is a rigid, positive connection between the cylinder head unit and cylinder block, which can lead to differing degrees of thermal expansion and hence mechanical stress between the cylinder block and cylinder head unit due to temperature differences within the engine block or due to different coefficients of thermal expansion. The disadvantage of the design disclosed in GB 2 425 570 A, as with that of WO 2004/111418 A1, is that at least one liner has to be pressed into the cylinder head unit as an additional step. Another disadvantage of both designs is that the intrinsically closed coolant passages are respectively integrated in a cast block and an internally lying core is necessary to produce these parts. High demands are also placed on the casting technology used as a result of the proposed constructions. Due to the split in space or room between the cylinder head unit and cylinder block unit of these known designs, it is also barely possible to make the engine construction to a design which saves on weight and is cost-efficient in terms of production.

The underlying objective of this invention is to propose an engine housing which eliminates or reduces these problems of quality and cost, as well as the risk of engine damage due to internal stress. Another objective of the invention is to ensure that the engine housing and an internal combustion engine fitted with it is capable of long periods of operation and can achieve a long service life.

These objectives are achieved as a result of the features according to one aspect of the invention, in particular by an engine housing with a cylinder block and a cylinder head unit, which cylinder head unit comprises a head portion and at least one integrally cast cylinder portion with an internally lying piston bearing surface, and the cylinder portion of the cylinder head unit can be pushed at least partially into the cylinder block in the axial direction of the cylinder portion, and the cylinder head unit can be clamped against the cylinder block in the axial direction of the cylinder portion by means of at least one fixing element. This results in an optimized unit and an improved engine housing which represents a sound basis for an internal combustion engine according to another aspect of the invention.

In other words, an engine housing with a cylinder block and a cylinder head is proposed, which cylinder head unit comprises a head portion and at least one integrally cast cylinder portion with an internally lying piston bearing surface. The cylinder portion of the cylinder head unit in this instance can be at least partially pushed in the axial direction of the cylinder portion into the cylinder block. At its internal face, the cylinder portion directly constitutes the sliding surface for a piston oscillating therein, thereby obviating the need for a separate piston liner. Furthermore, the cylinder head unit can be clamped against the cylinder block in the axial direction of the cylinder portion by means of at least one fixing element.

One advantage of the design proposed by the invention resides in the fact that there is no dividing or joint surface between the head portion of the cylinder head unit and the integrally cast cylinder portion and there is therefore no need for a cylinder head gasket to seal the combustion chamber. One particular advantage of the design proposed by the invention is the fact that the cylinder portion can be moved in the axial direction relative to the cylinder block, making assembly of the engine simple. Furthermore, relative movements which might occur due to changes in temperature at the contact surfaces or transition points between the cylinder block and cylinder portion can be largely compensated, thereby minimizing or preventing mechanical stress in the engine housing as far as possible. Especially if the cylinder head unit and the cylinder block at least partially accommodating the cylinder head unit are made from different materials with different coefficients of thermal expansion, the specified design is of particular advantage. Also of advantage is the fact that because the cylinder head unit can be clamped in the axial direction of the cylinder portion against the cylinder block, the cylinder head unit is exactly defined in terms of its position relative to the cylinder block. As a result, the main forces which occur in the engine housing as the fuel is being combusted are absorbed in their main direction. Due to the so-called "wet cylinder liner" or due to the "wet piston liner", whereby the external surface of the cylinders can be placed in direct contact with the coolant, heat can be transferred efficiently and rapidly to the coolant, thereby resulting in a good dissipation of heat or cooling in the internal combustion engine even under high loads so that a long service life and good operating reliability can be achieved. The fact that there is no need to provide separate liners for the pistons based on the design proposed by the invention, which liners would then each have to be pressed into the cylinders, is conducive to cooling performance and cooling behavior with respect to the engine cylinders and also means that an extremely cost-effective design of the engine housing can be achieved.

It may also be expedient to provide at least one coolant passage for circulating a cooling medium between the cylinder head unit and cylinder block, which coolant passage is sealed off from the environment outside the engine housing by means of at least one seal element at a first transition point between the head portion and cylinder block as well as being sealed off from a crankcase for accommodating a crankshaft by means of at least one other seal element at another transition point between the cylinder portion and cylinder block. The advantage of this is that the coolant passage is not an internally lying chamber integrated in one of the two cast parts. Consequently, internally lying mold cores, i.e. so-called lost mold cores, which are expensive and problematic from a production point of view, are not necessary for the casting process or are reduced. Based on the proposed construction, the coolant passage is formed directly around the casing portion of the cylinder portion by the geometry or boundary surfaces of adjoining portions of the cylinder head unit and cylinder block. Opting for structurally separate seal elements means that reliable sealing of the coolant passage between the mutually adjacent parts can be achieved for longer periods. Another particular advantage resides in the fact that heat-induced relative movements and thermal expansion due to temperature differences have no or only a marginal effect on sealing of the coolant passage and a reliable seal can therefore be achieved.

Furthermore, at least one seal element may be provided at the other transition point between the cylinder portion and cylinder block at a height offset from another seal element of an adjacent cylinder portion. The advantage of this feature is that the mounting space or distance between the individual cylinder portions, i.e. the distance or so-called cylinder base dimension between the cylinders, can be kept relatively small or narrow. This enables the length of internal combustion engines with in-line cylinders to be kept as short as possible. This is achieved due to the fact that the recesses for accommodating sealing rings in the individual cylinders are offset in height from the recesses for accommodating sealing rings in an adjacently lying cylinder. In addition, the recesses in the individual adjacently disposed cylinders can be made sufficiently deep without weakening the material too much due to excessive necking of the intermediate web between directly adjacent cylinders. The height offset between recesses of adjacently lying cylinders can therefore be selected so that it is large enough to ensure a minimum thickness of material in the region of the groove-shaped recesses in the intermediate web.

Furthermore, transition surfaces may be provided at the first transition point between the head portion and cylinder block and transition surfaces may be provided at the other transition point between the cylinder portion and cylinder block oriented at an angle, in particular a right angle, to one another. The advantage of this is that the corresponding parts are easy to produce during the manufacturing process and an effective mutual support and load transmission is obtained.

One feature is also advantageously provided, whereby inlet and outlet passages leading into the combustion chamber are disposed in the head portion of the cylinder head unit as well as at least one mounting orifice for an injection nozzle or a spark plug. In this respect, it is of particular practical advantage if allowance is made for the material recesses in the casting process already so that the amount of material which still has to be removed in a finishing process is kept small.

Based on one particular feature, it is possible for the fixing element by means of which the cylinder head unit can be clamped in the axial direction of the cylinder portion against the cylinder block is also provided as a means of or designed to apply a clamping force to a bearing shell of a crankshaft bearing. The advantage of this is that by reference to the vertical axis of the engine, the parts which are subjected to high stress due to the internal combustion pressures in the engine can be screwed together and clamped to one another by as few screw connections as possible, thereby resulting in efficient'force transmission and absorption of the forces which occur. Also as a result, the time involved in assembling the engine housing can be kept as short as possible, thereby obtaining a good basis for cost-effective production. In particular, at least one screw connection is provided, which screws the bearing shell for a main bearing of the crankshaft, the cylinder block and the cylinder head unit to one another to obtain a single-piece component unit. The at least one fixing element is preferably anchored or screwed into the cylinder head portion, whilst its screw head is supported on the bearing shell. The shaft of the at least one fixing element extends through a bore in the cylinder block.

Furthermore, an axial length of the cylinder portion of the cylinder head unit may be between 50% and 200%, in particular between 80% and 110%, preferably approximately 100%, of a wall height of the cylinder block. The advantage of this is that the cylinder block occupies the greatest possible volume and proportion of material of the engine construction, which means that by opting for a cylinder block material with a relatively low density, for example aluminum, the total weight of the engine housing can be reduced and made comparatively low.

The cylinder portion in the region of its other transition point to the cylinder block may have an approximately cylindrical or conical external casing surface and is accommodated in the cylinder block without any clearance. The advantage of this is that the cylinder portion can be pushed into the cylinder block in its axial direction and positioned and fixed as intended. Another advantage is that because the cylinder portion is able to move axially relative to the cylinder block, any relative movements caused by different temperature-induced degrees of thermal expansion can be compensated relatively free of stress.

It is also of practical advantage if the cylinder head unit has a shoulder surface extending normally to the axial direction of the cylinder portion, by means of which the cylinder head unit can be supported on the cylinder block and clamped against the cylinder block. The advantage of this is that machining is made easy due to the orientation of this shoulder or support surface. Also of advantage is the fact that by clamping the two parts to one another in this shoulder surface, optimum force transmission for absorbing the engine forces is obtained. Especially if force is transmitted at a right angle to the shoulder surface, expansion and chocking forces can be prevented.

Based on another advantageous embodiment, a top end face of the cylinder block lies approximately on a level with a plane containing a cylinder base of the cylinder head unit in the axial direction of the cylinder portion. The advantage of this is that the cylinder block occupies the greatest possible volume and component structure of the engine construction so by opting for a low-density material for the cylinder block, for example cast aluminum, the total weight of the engine housing can be reduced.

In particular, it may be of advantage if the cylinder head unit is made from a first material with a first material density and the cylinder block is made from another material with a different material density from the first material. This ensures that the material properties which are regarded as optimum for the respective functional parts of the engine can be selected. The cylinder head unit formed directly or integrally with the cylinder portion used directly as the piston liner may be made from a material which is sufficiently capable of withstanding load and is resistant to wear, has good gliding properties and is also optimum in terms of withstanding high combustion temperatures and high pressures in the interior of the combustion chamber, for example. In terms of costs and technical requirements, this enables the most optimized casting process to be used for processing aluminum or gray-cast iron.

Based on another advantageous embodiment, the material of the cylinder head unit has a higher material density than the material of the cylinder block. The advantage of this is that the overall weight of the engine construction can be reduced because in the case of parts exposed to relatively low mechanical and thermal stress, such as the cylinder block, at least a major part of the assembled material volume has a relatively low density. Above all the material used to make the cylinder head unit, which is exposed to relatively high mechanical and thermal load, is expediently made from a material with a relatively high density and is therefore better able to meet thermal and mechanical requirements.

In particular, based on one practical embodiment, the cylinder head unit may be made from gray-cast iron and directly constitutes the piston bearing surface, and the cylinder block may be made from aluminum or cast aluminum. The advantage of this is that gray-cast iron has a relatively good resistance to wear and a relatively high temperature resistance. In addition, aluminum or cast aluminum is easy to handle during the casting process. Using aluminum for the cylinder block offers another advantage in that it has a very low density compared with gray-cast iron, thereby enabling a relatively light-weight construction of the engine housing to be obtained.

Based on one practical feature, a coolant passage for circulating a coolant fluid in a terminal end portion of the engine housing is bounded by the first material of the cylinder head unit on the one hand and is bounded by another material of the cylinder block that is different from it on the other hand. This results in a so-called "wet piston liner", ensuring good cooling behavior and high cooling performance for the cylinders of the engine housing. It is also possible to opt for a material pairing which makes optimum use of the advantages of the material properties.

Finally, the cylinder block may serve as at least one part-portion of a crankcase in its end portion lying opposite the opening for accommodating the cylinder head unit. The advantage of this is that based on the design of the biggest possible, cohesive functional units, the latter can be cast as a single piece. This avoids dividing planes, one advantage of which is that it saves on seal material. Secondly, the number of components needed to assemble the engine housing can be drastically reduced, thereby keeping assembly and building costs low.

To provide a clearer understanding, the invention will be described in more detail below with reference to the appended drawings.

These are very simplified, schematic diagrams illustrating the following:

Figure 1:
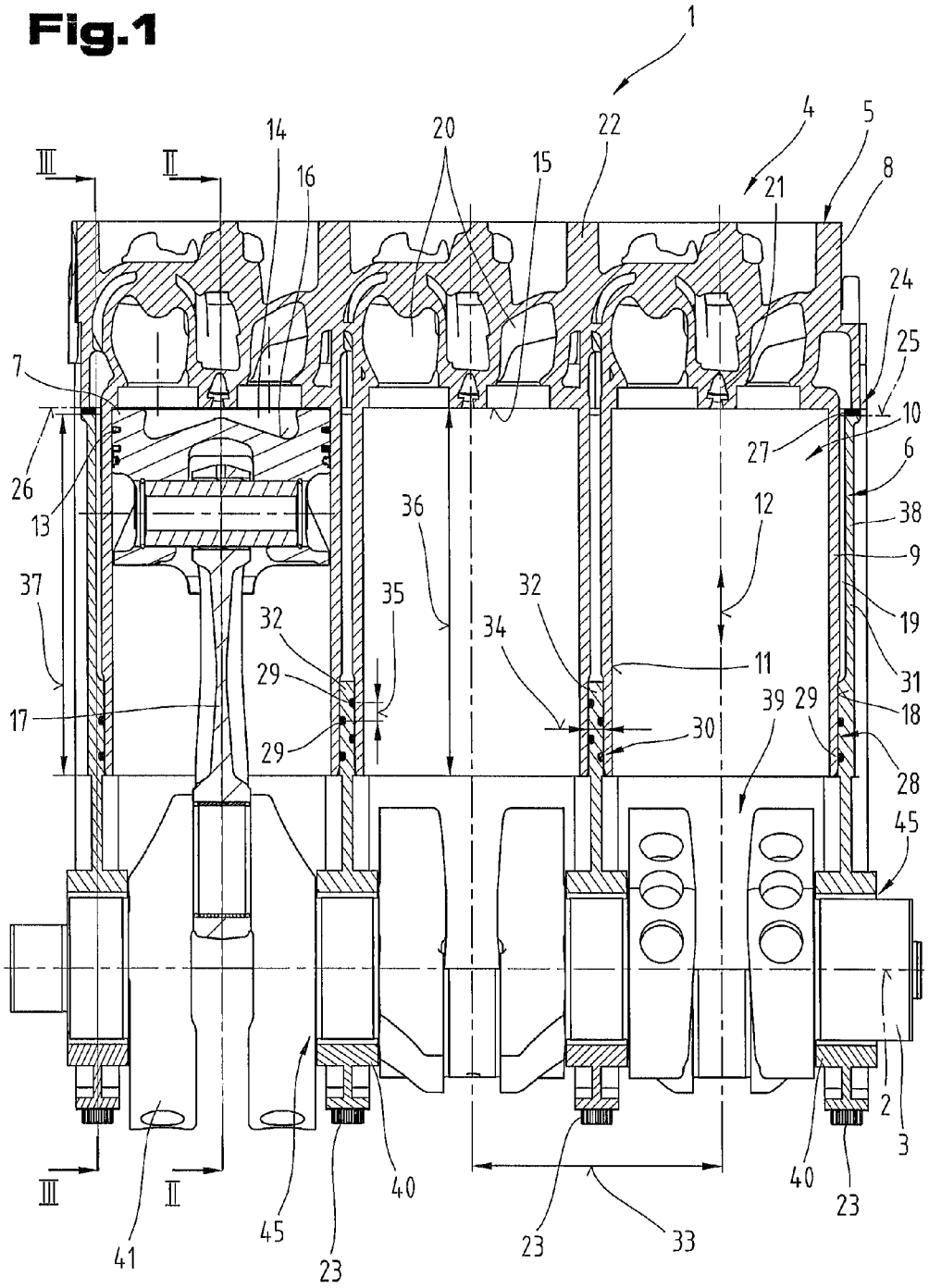
FIG. 1 shows a vertical longitudinal section through an internal combustion engine along the axis of the crankshaft.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 shows a section through an internal combustion engine 1 along an axis 2 of the crankshaft 3. The internal combustion engine 1 illustrated in this diagram comprises an engine housing 4 with a cylinder head unit 5 and a cylinder block 6. Also accommodated in the engine housing 4 are at least one piston 7 and a crankshaft 3. The cylinder head unit 5 illustrated is made up of a head portion 8 and at least one cylinder portion 9. The head portion 8 and cylinder portion 9 are produced integrally, in particular from an individual cast piece. In this respect, it is possible to provide a cylinder head unit 5 for each cylinder 10 respectively each cylinder portion 9, in which case it is made up of a head portion 8 and a cylinder portion 9. However, it would also be possible for one cylinder head unit 5 to be designed with several cylinders 10, in which case it comprises one head portion 8 and several cylinder portions 9. The head portion 8 respectively fulfils the function of providing a mount for the valves and for controlling the valves for the combustion chamber of the internal combustion engine 1. In the case of the embodiment illustrated in FIG. 1, an internal combustion engine 1 is illustrated which has three cylinders 10 and pistons 7. In the embodiment illustrated as an example, the cylinder head unit 5 comprises a one-piece cohesive head portion 8 and three cylinder portions 9 formed thereon, each of which is provided as a means of guiding one of the pistons 7 in a sliding movement.

At its internal wall or internal surface, the cylinder portion 9 directly forms a piston bearing surface 11, along which the piston 7 is able to move in an oscillating motion in the axial direction 12 of the cylinder portion 9. The piston bearing surface 11 formed by the material of the cylinder head unit 5 affords a sufficiently stable and exact guide for the piston 7. An adequate seal between the piston bearing surface 11 and the piston 7 guided by it is provided by several piston rings 13 retained on the casing surface of the piston 7. The combustion chamber 14 is therefore sufficiently sealed to convert the pressure created in the combustion chamber 14 into an oscillating movement of the piston 7 as the fuel is combusted and as far as possible allows no combustion gases to flow in the direction towards the crankshaft 3 or in the direction towards the crankcase 39.

The combustion chamber 14 is bounded by a plurality of surfaces. It is bounded firstly by the cylinder base 15, which is defined by the cylinder head unit 5 and constitutes a fictitious dividing or transition surface between the head portion 8 and the cylinder portion 9. Secondly, the combustion chamber 14 can be defined by the piston bearing surface 11 of the cylinder portion 9. In addition, the combustion chamber 14 is bounded by the piston base 16 which typically extends into a combustion chamber depression disposed at the end of the piston 7 facing away from the connecting rod 17.

The cylinder portion 9 is defined by a relatively thin-walled, hollow cylinder element and at least a part-portion of the outer casing surface 18 of the cylinder portion 9 constitutes a boundary surface of the coolant passage 19. The cylinder portion 9 is cast directly on the head portion 8 or is made together with it in one casting.

High requirements are placed on the piston bearing surface 11 due to the rapid relative movements between the piston 7 and cylinder portion 9. Its surface properties, resistance to temperature, resistance to wear as well as its manufacturing tolerances in particular must satisfy especially high demands in order to prevent excessive wear on the parts and surfaces which slide on one another. Furthermore, surfaces which sit in contact must guarantee the best possible mutual seal.

The outer casing surface 18 of the cylinder portion 9 is predominantly of a cylindrical design. Another option is for the outer casing surface 18 of the cylinder portion 9 to be of a conical or frustoconical design in the end portion remote from the head portion 8 and/or to provide a shoulder.

The head portion 8 of the cylinder head unit 5 has inlet and outlet passages 20 for a gas exchange in the combustion chamber 14 as well as at least one mounting orifice 21 for an injection nozzle, a glow plug or a spark plug, for example. The embodiment of the engine housing 4 illustrated FIGS. 1 to 3 seems to be of particular advantage in the case of an internal combustion engine 1 running with diesel. Valve seats are fitted in the inlet and outlet passages 20 in which the valves responsible for a regulated gas exchange in the combustion chamber 14 are accommodated. The main body of the cylinder head unit 5 described above is made from a first material 22 and is cast as a single piece by means of a casting process. Compared with the material used for the cylinder block 6, this first material 22 has a relatively high strength or ability to withstand load and a high surface hardness. It is also of advantage if this first material 22 used for the cylinder head unit 5 has good wear resistance properties and is able to withstand the high temperatures and pressures in the combustion chamber 14.

The cylinder head unit 5 is secured to the engine housing 4 and cylinder block 6 by means of at least one fixing element 23 and is also pre-tensioned in the direction towards the cylinder block 6. It is of practical advantage if the cylinder head unit 5 is connected to the cylinder block 6 by means of a plurality of fixing elements 23, in particular in the form of screws. One practical option is to provide two screw-type fixing elements 23 per main bearing for the crankshaft 3—FIG. 3—in which case, in the embodiment illustrated as an example of a 3-cylinder internal combustion engine 1—FIG. 1—there is a total of eight fixing elements 23 for securing the cylinder head unit 5 to the cylinder block 6 and for simultaneously retaining the crankshaft 3 so that it is rotatable on the cylinder block 6 and in its crankcase 39.

The above-mentioned coolant passage 19 or coolant passages 19 around the cylinders 10 are predominantly disposed between internal surfaces of the cylinder block 6 and the external surfaces of the cylinder head unit 5 adjacent thereto. Accordingly, two boundary surfaces of the cylinder head unit 5 and the cylinder block 6 meet one another and have to be sealed to prevent the coolant fluid from escaping. A first transition point 24 between the cylinder head unit 5 and cylinder block 6 is disposed approximately on a level with the cylinder base 15 and the corresponding dividing or joint plane is disposed horizontally and formed by a top end face 25 of the cylinder block 6 and by a shoulder surface 26 of the cylinder head unit 5. A seal element 27 is provided between these two surfaces 25, 26 in order to seal the coolant passage 19. This seal element 27 may be a single flat plastic seal, for example. However, it would also be possible for the seal element 27 to be provided in the form of a metal layered seal where the core of the seal is made from spring steel and the outer surfaces are made from thin elastomer layers.

Another transition point 28 between the cylinder head unit 5 and cylinder block 6 is disposed in the end portion of the cylinder portion 9 remote from the head portion 8. This transition point 28 is sealed by at least one other seal element 29. The seal element 29 used in this instance is preferably provided in the form of at least one sealing ring, in particular by at least one O-ring, retained in a co-operating recessed groove 30 of the cylinder block 6. These recessed grooves 30 disposed on the outer cylinders 10 of the engine housing 4 fit on the internal face of casing walls 31 of the cylinder block 6. In the situation where several cylinders 10 are provided in an internal combustion engine 1, other recessed grooves 30 for the seal elements 29 are provided opposite centrally disposed cylinders 10 in at least one intermediate web 32 of the cylinder block 6.

In the embodiment illustrated as an example in FIG. 1, an internal combustion engine 1 with several cylinders 10 is illustrated. In order to keep the axial distance 33 or so-called cylinder base dimension between the individual cylinders 10 as short as possible, the wall thickness 34 of the intermediate webs 32 is also designed to be as slim as possible. Due to the recessed grooves 30 provided for the seal elements 29, the intermediate webs 32 are further weakened. If two recessed grooves 30 of adjacent cylinders 10 were to be provided at the same height level, i.e. exactly opposite, the intermediate web 32 would be weakened to a high degree by the recessed grooves 30 on either side. In order to minimize the degree of weakening of the intermediate web 32, the recessed grooves 30 of adjacent cylinders 10 are ideally not provided at the same height or height level but are offset from one another by a specific height 35. This ensures that the intermediate web 32 can be made with the thinnest possible wall thickness 34 but nevertheless affords sufficient strength and stability.

In the embodiment illustrated in in FIG. 1, the axial length 36 of the cylinder portion 9 is ca. 100% of the wall height 37 of the cylinder block 6. In design terms, this ratio may be selected from between approximately 50% and 200%. If this value is selected towards the higher end of the range, a higher proportion of the first material 22 will be needed to make the engine housing 4 and this first material 22 is typically heavier or has a higher material density than another material 38 different from the first material 22 used to make the cylinder block 6. If the value is selected towards the lower end of the range, the external casing walls 31 of the cylinder block 6 will have to extend further upwards relatively speaking.

The cylinder block 6 is preferably made from another material 38 which is lighter and has a lower density than the material of the cylinder head unit 5. This other material 38 must have a strength at least high enough to ensure that the forces occurring in the engine housing 4 can be absorbed without damage to the material structure. An example of such a material 38 is the embodiment of the cylinder block 6 made from cast aluminum.

Figure 2:
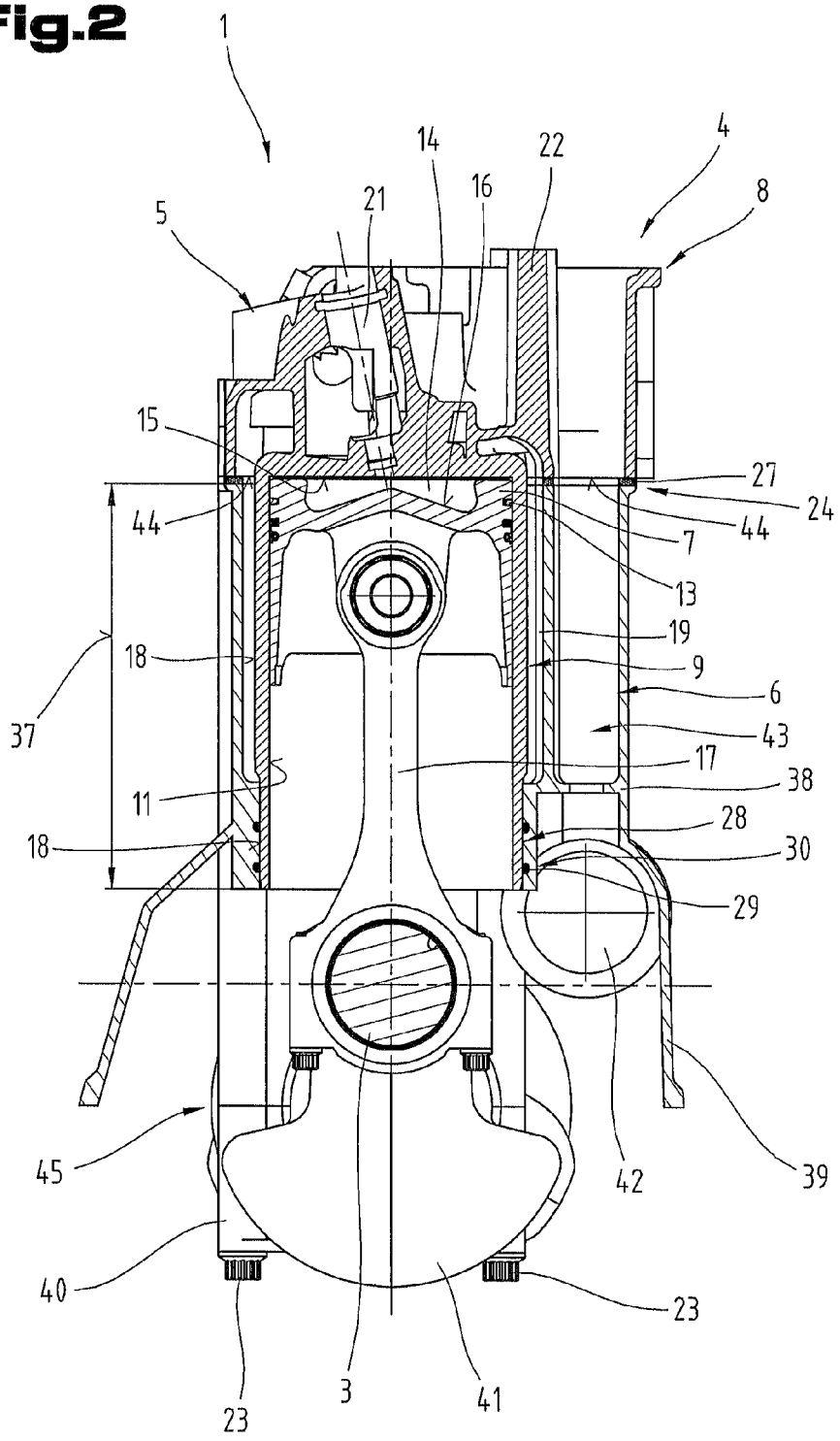
FIG. 2 is a section through a cylinder of the internal combustion engine illustrated in FIG. 1 with a section plane perpendicular to the crankshaft axis, in particular along line II-II indicated in FIG. 1.

FIG. 2 illustrates the internal combustion engine 1 in a cross-section extending through the cylinder center of a cylinder 10 and perpendicular to the axis 2 of the crankshaft 3. Elements of the internal combustion engine 1 disposed in the crankcase 39 are illustrated in this section. As may be seen in particular, the bearing shell 40 of a crankshaft bearing, in particular a crankshaft main bearing, is screwed to the cylinder block 6 and also simultaneously to the cylinder head unit 5 by means of a pair of fixing means 23. The bearing shell 40 is partially obscured by a balancing mass 41 of the crankshaft 3. To provide greater clarity, an oil pan constituting the bottom termination of the crankcase 39 is not illustrated.

As also illustrated in FIG. 2, a recess 42 is provided for the camshaft as well as a cut-out 43 for rods needed for operating the valves. However, the camshaft and rods are not illustrated in this diagram. In the embodiment of the internal combustion engine 1 illustrated, the valves are operated in such a way that the camshaft lying to the side of the cylinders 10 transmits an operating force to the vertically extending rods. The rods then in turn transmit the corresponding actuating motion to a rocker arm lying at the top, which then operates the valves.

As may readily be seen from this diagram, a shoulder surface 44 is provided on the cylinder head unit 5 in the transition region between the head portion 8 and cylinder portion 9. This shoulder surface 44 lies on the end face 25 of the cylinder block 6 and can therefore absorb the pre-tensioning force generated by the at least one fixing element 23 and transmit it to the cylinder block 6.

Figure 3:
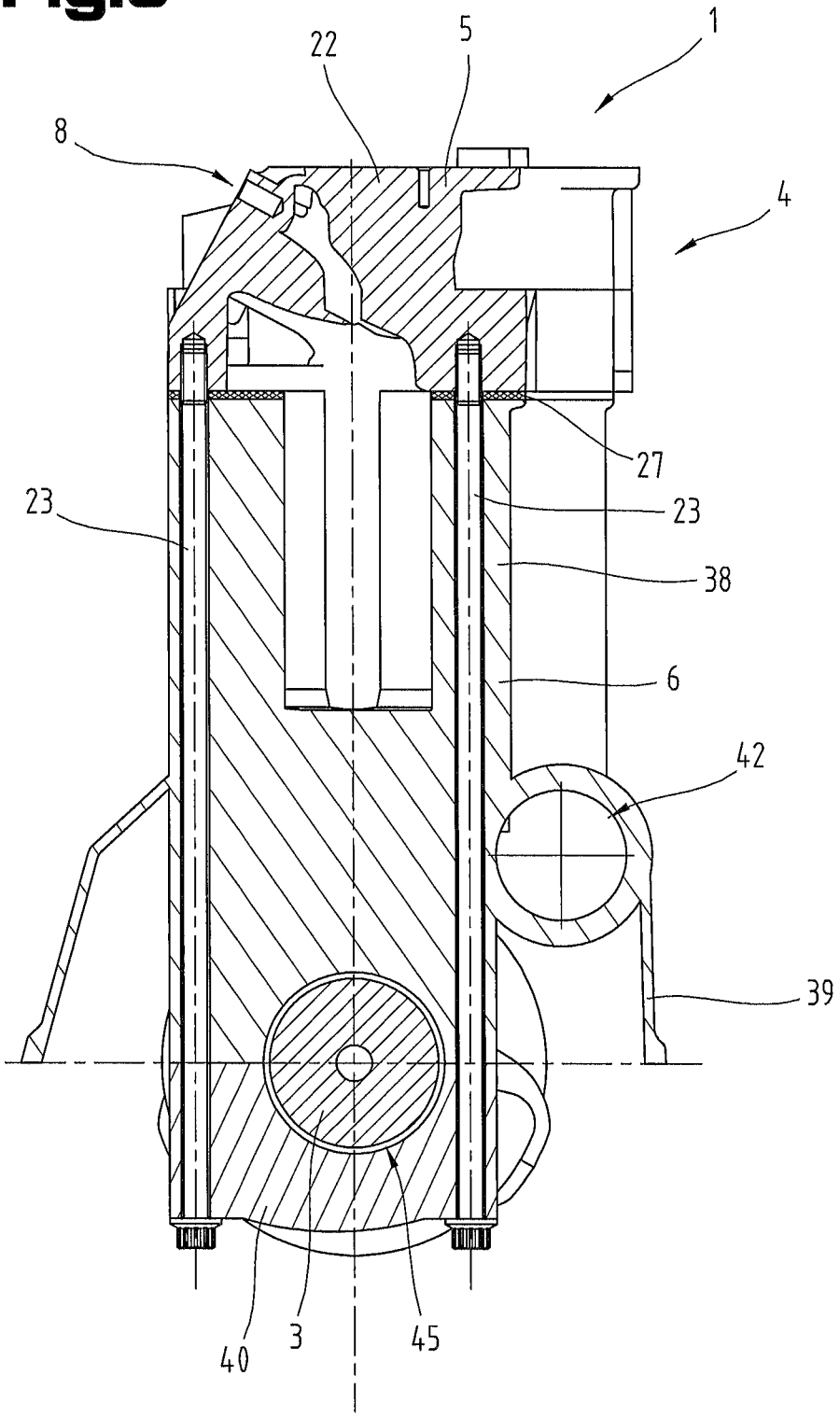
FIG. 3 is a section parallel with the fixing arrangement and parallel with the fixing means for the main components of the internal combustion engine illustrated in FIG. 1, with a section plane perpendicular to the crankshaft axis, in particular along line indicated in FIG. 1.

FIG. 3 illustrates a section through the internal combustion engine 1 in the plane of a pair of fixing elements 23. A bearing shell 40 of the crankshaft bearing 45 is clearly visible, which bearing shell 40 is connected by two screw-type fixing elements 23 to the cylinder block 6, and these fixing elements 35 are then screwed to the head portion 8 of the cylinder head unit 5 and anchored in the head portion 8. Accordingly, the cylinder block 6 is clamped to a certain extent between at least one bearing shell 40, which completes a crankshaft bearing 45, and the head portion 8 of the cylinder head unit 5.

As may also be seen, the fixing elements 23 are provided in the form of screws, which extend from the back of the bearing shell 40 into the cylinder head unit 5. Accordingly, the bearing shell 40 and cylinder block 6 are provided with simple bores through which the shafts of the fixing elements 23 extend. The cylinder head unit 5 is provided with a threaded bore for each fixing element 23, into which the fixing elements 23 are screwed. The fixing elements 23 apply sufficient clamping force to the contact surfaces and transition point 24 between the cylinder head unit 5 and cylinder block 6 as well as to the contact surfaces between the cylinder block 6 and the bearing shells 40. The crankshaft bearing 45 accommodating the crankshaft 3 in a rotatable arrangement is defined between the at least one bearing shell 40 and the cylinder block 6.

The embodiments illustrated as examples represent possible variants of the engine housing 4, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

Furthermore, individual features or combinations of features from the different examples of embodiments described and illustrated may be construed as independent inventive solutions proposed by the invention in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 1 to 3 constitute independent solutions proposed by the invention in their own right. The objectives and associated solutions proposed by the invention may be found in the detailed descriptions of these drawings.

For the sake of good order, it should finally be pointed out that in order to provide a clearer understanding of the structure of the engine housing 4, it and its constituent parts have been illustrated out of scale to a certain extent and/or on an enlarged and/or reduced scale.

List of Reference Numbers

| | |
|---|---|
| 1 | Internal combustion engine |
| 2 | Axis |
| 3 | Crankshaft |
| 4 | Engine housing |
| 5 | Cylinder head unit |
| 6 | Cylinder block |
| 7 | Piston |
| 8 | Head portion |
| 9 | Cylinder portion |
| 10 | Cylinder |
| 11 | Piston bearing surface |
| 12 | Axial direction |

-continued

| | |
|---|---|
| 13 | Piston ring |
| 14 | Combustion chamber |
| 15 | Cylinder base |
| 16 | Piston base |
| 17 | Connecting rod |
| 18 | External casing surface |
| 19 | Coolant passage |
| 20 | Inlet and outlet passages |
| 21 | Mounting orifice |
| 22 | First material |
| 23 | Fixing element |
| 24 | First transition point |
| 25 | End face |
| 26 | Shoulder surface |
| 27 | Seal element |
| 28 | Other transition point |
| 29 | Other seal element |
| 30 | Recessed groove |
| 31 | Casing wall |
| 32 | Intermediate web |
| 33 | Axial distance |
| 34 | Wall thickness |
| 35 | Height |
| 36 | Axial length |
| 37 | Wall height |
| 38 | Other material |
| 39 | Crankcase |
| 40 | Bearing shell |
| 41 | Balancing mass |
| 42 | Recess for the camshaft |
| 43 | Cut-out for the rod |
| 44 | Shoulder surface |
| 45 | Crankshaft bearing |

The invention claimed is:

1. An engine housing comprising a cylinder block and a cylinder head unit, which cylinder head unit comprises a head portion and at least one integrally cast cylinder portion with an internally lying piston bearing surface, wherein the cylinder portion of the cylinder head unit can be pushed at least partially into the cylinder block in the axial direction of the cylinder portion, wherein the cylinder head unit can be clamped in the axial direction of the cylinder portion against the cylinder block by means of at least one fixing element, wherein at least one coolant passage for circulating a cooling medium is provided between the cylinder head unit and cylinder block, which coolant passage is sealed off from the environment outside the engine housing by means of at least one seal element at a first transition point between the head portion and cylinder block, and is sealed off from a crankcase for accommodating a crankshaft by means of at least one other seal element at another transition point between the cylinder portion and cylinder block, wherein the cylinder portion has a cylindrical or conical external casing surface in the region of its other transition point to the cylinder block, wherein the other seal element used in this instance is retained in a cooperating recessed groove of the cylinder block, wherein the at least one other seal element at the other transition point between the cylinder portion and cylinder block is disposed offset from the other seal element of an adjacent cylinder portion by a height, and wherein in adjacent cylinder portions none of the other seal elements are located in the same height.

2. The engine housing according to claim 1, wherein transition surfaces at the first transition point between the head portion and cylinder block and transition surfaces at the other transition point between the cylinder portion and cylinder block are angled, in particular oriented at a right angle to one another.

3. The engine housing according to claim 1, wherein inlet and outlet passages leading into the combustion chamber are provided in the head portion of the cylinder head unit as well as at least one mounting orifice for an injection nozzle or a spark plug.

4. The engine housing according to claim 1, wherein the fixing element by which the cylinder head unit can be clamped in the axial direction of the cylinder portion against the cylinder block is additionally designed to apply a pre-tensioning force to a bearing shell of a crankshaft bearing.

5. The engine housing according to claim 1, wherein an axial length of the cylinder portion of the cylinder head unit is between 50% and 200%, in particular between 80% and 110%, preferably approximately 100%, of a wall height of the cylinder block.

6. The engine housing according to claim 1, wherein the cylinder head unit has a shoulder surface extending normally to the axial direction of the cylinder portion by means of which the cylinder head unit is supported on the cylinder block and which can be clamped against the cylinder block.

7. The engine housing according to claim 1, wherein a top end face of the cylinder block lies approximately on a level with a plane in which a cylinder base of the cylinder head unit is accommodated.

8. The engine housing according to claim 1, wherein the cylinder head unit is made from a first material with a first material density and the cylinder block is made from another material with a different material density from the first material.

9. The engine housing according to claim 8, wherein the cylinder head unit is made from gray-cast iron and directly constitutes the piston bearing surface and the cylinder block is made from aluminum or cast aluminum.

10. The engine housing according to claim 8, wherein a coolant passage for circulating a coolant fluid in a terminal end portion of the engine housing is bounded by the first material of the cylinder head unit on the one hand and by the other material different therefrom of the cylinder block on the other hand.

11. The engine housing according to claim 8, wherein the material of the cylinder head unit has a higher material density than the material of the cylinder block.

12. The engine housing according to claim 1, wherein the cylinder block forms at least a part-portion of a crankcase in its end portion lying opposite the mounting orifice for the cylinder head unit.

13. An internal combustion engine comprising an engine housing with a cylinder head unit and a cylinder block, in which engine housing at least one piston and at least one crankshaft are accommodated, wherein the engine housing is as defined in claim 1.

14. An engine housing comprising a cylinder block and a cylinder head unit, which cylinder head unit comprises a head portion and at least one integrally cast cylinder portion with an internally lying piston bearing surface, wherein the cylinder portion of the cylinder head unit can be pushed at least partially into the cylinder block in the axial direction of the cylinder portion, wherein the cylinder head unit can be clamped in the axial direction of the cylinder portion against the cylinder block by means of at least one fixing element, wherein at least one coolant passage for circulating a cooling medium is provided between the cylinder head unit and cylinder block, which coolant passage is sealed off from the environment outside the engine housing by means of at least one seal element at a first transition point between the head portion and cylinder block, and is sealed off from a crankcase for accommodating a crankshaft by means of at least one other seal element at another cylindrical transition point between the cylinder portion and cylinder block, wherein the other seal element used in this instance is retained in a cooperating recessed groove of the cylinder block, wherein the at least one other seal element at the other transition point between the cylinder portion and cylinder block is disposed offset from the other seal element of an adjacent cylinder portion by a height, and wherein in adjacent cylinder portions none of the other seal elements are located in one height level.

* * * * *